United States Patent [19]

Yamamoto et al.

[11] 3,969,213

[45] July 13, 1976

[54] ALUMINUM ELECTROLYTIC CELLS

[75] Inventors: Shoji Yamamoto; Masahiko Eki; Kimihiko Kato, all of Tomakomai, Japan

[73] Assignee: Nippon Light Metal Company Limited, Tokyo, Japan

[22] Filed: Oct. 25, 1974

[21] Appl. No.: 517,968

[30] Foreign Application Priority Data

Oct. 26, 1973 Japan ..... 48-119977

[52] U.S. Cl. ..... 204/244; 204/243 M

[51] Int. Cl.[2] ..... C25C 3/06; C25C 3/16

[58] Field of Search ..... 204/243 M, 244, 243 R, 204/67

[56] References Cited

UNITED STATES PATENTS

| | | | |
|---|---|---|---|
| 3,063,919 | 11/1962 | Jouguet et al. | 204/244 X |
| 3,617,454 | 11/1971 | Johnson | 204/244 X |
| 3,756,938 | 9/1973 | Nebell | 204/243 M |
| 3,775,281 | 11/1973 | Schmidt-Hatting | 204/244 |

*Primary Examiner*—G. L. Kaplan

*Attorney, Agent, or Firm*—William J. Daniel

[57] ABSTRACT

Electromagnetic effects are optimized in a rectangular aluminum reduction cell arranged in series in a row of such cells with the cathode collector bars thereof extending through the cell cathode parallel to the row length by utilizing generally L-shaped cathode bus bars connecting the upstream ends of the cathode collector bars to line bus bars adjacent the cell ends, the L-shaped cathode bus bars each having one leg extending from its connectors with the upstream ends of at least one cathode collector bar beneath the cell to approximately the longitudinal cell axis and the other leg extending to the right or left generally along said longitudinal cell axis to connect with a line bus bar. The downstream ends of the cathode collector bars are arranged in conventional fashion. The present arrangement minimizes wave formation in the aluminum layer and promotes circulation of the electrolytic bath.

5 Claims, 7 Drawing Figures

ALUMINUM ELECTROLYTIC CELLS

Figure 1:
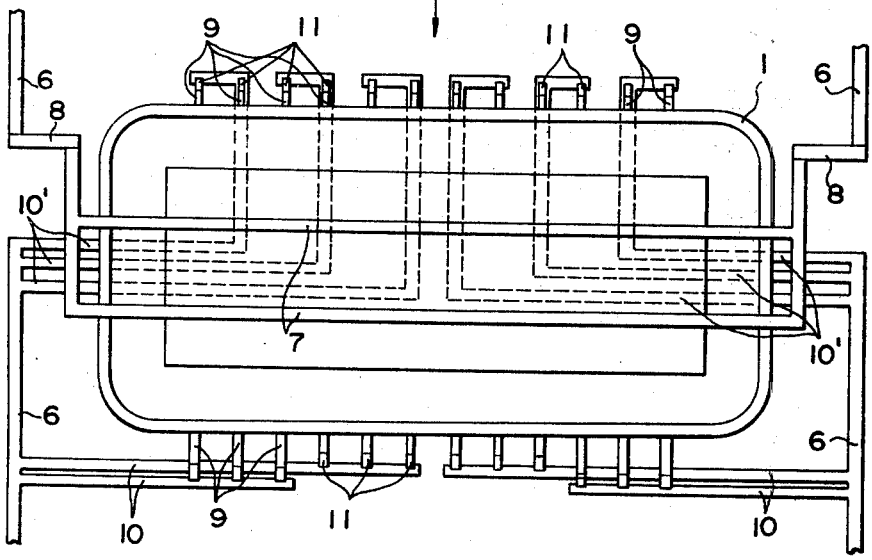

This invention relates to improvements in the design of an aluminum electrolytic cell. More particularly the present invention concerns an improved arrangement of the current conducting bus bars installed around each of a plurality of aluminum electrolytic cells which are connected electrically in series and disposed physically in a row in an aluminum production pot-room in a way that the longitudinal sides of the rectangular potshells of the respective cells face with each other. Such a physical placement of the cells is hereinafter referred to as a side by side placement.

In the electrolytic production process of aluminum known as the Hall-Heroult process, the production unit is a cell which usually has the form of a rectangular steel potshell lined with carboneous materials. The cell contains a body or bath of molten electrolyte mainly composed of fused cryolyte in which aluminum oxide (alumina) is dissolved. Carbon anodes are suspended from above in such a way as to immerse their lower ends in the molten bath. Electric current is passed through the carbon anodes, the electrolyte and the carbon lining, which acts as the cathode, to cause the alumina dissolved in the bath to be electrolyzed and aluminum metal to be precipitated in a molten state in the shell under the cryolite bath.

In an aluminum production plant, a number of such electrolytic cells are installed in rows in a potroom and all of the cells in a given row are electrically connected in series, i.e. the cathode of one cell is connected to the anode of the next downstream cell with a set of current bus bars.

Rows of such cells are likewise connected in series to constitute a total "line" of cells which receives the electric current from the power source.

The terms "downstream" and "upstream" in the description of the invention are used with reference to the general direction of flow of electric current through a given cell row and the position of parts of the system in relating to that flow.

Due to the strong electric current flow through the cells and the conducting bus bars installed around the cells, a strong magnetic field is generated inside the cells and influences cell operation in various ways. Recent trends toward increasing the current intensity of the cells to a lead greatly exceeding 100,000 amperes makes these influences too great to be ignored when maximum operating efficiencies are desired.

Among such influences caused by the magnetic field generated by the current passing through various conducting elements, the one that affects electrolytic operation most seriously is a violent horizontal circulation of the molten aluminum layer caused by the electromagnetic forces induced by the interaction between the vertical component of the magnetic field in the cell and the horizontal component of the current flowing through the molten aluminum layer. Such circulating movements will cause wave-like fluctuations at the surface of the molten aluminum layer resulting in localized short-circuiting which lowers the efficiency of electrolysis markedly and tends to reduce the life of the cell lining along with other disadvantageous results.

The principal object of this invention is to avoid the above mentioned disadvantageous effects of the electromagnetic forces created during cell operation as much as possible and at the same time utilize some of the electromagnetic forces in ways useful for cell operation by improving the arrangement of the conducting bus bars around the cell.

More specifically, this invention is an improved bus bars arrangement for a "side by side placement" aluminum reduction cell; wherein a. the upstream side cathode bus bars are formed of two sectors and the first part thereof being connected at one end to the upstream side cathode collector bars and extending underneath the potshell in the direction parallel to the transverse axis of the individual cell to the vicinity of the longitudinal axis of said cell, and then intersecting at a right angle, with the other section thereof which is diverted to the left or right, according to its location to the left and right, respectively, of the transverse center line of the cell, and extends toward the corresponding end of the cell generally along the longitudinal cell axis, b. the downstream side cathode bus bars which are connected at one end to the downstream side cathode collecter bars, are also diverted to the left or right in the same way extend toward the ends of said cell parallel to the longitudinal cell axis as normally, and c. the various cathode bus bars are connected at their free ends to the line bus bars.

Figure 2:
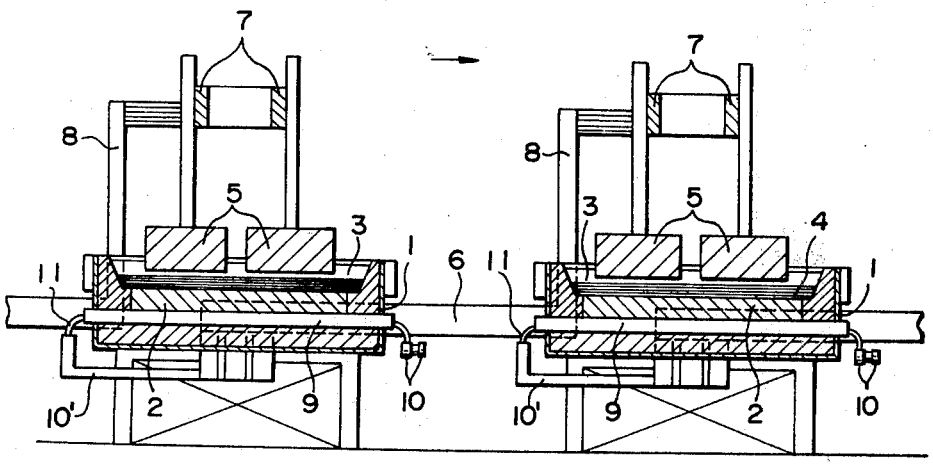
Figure 3:
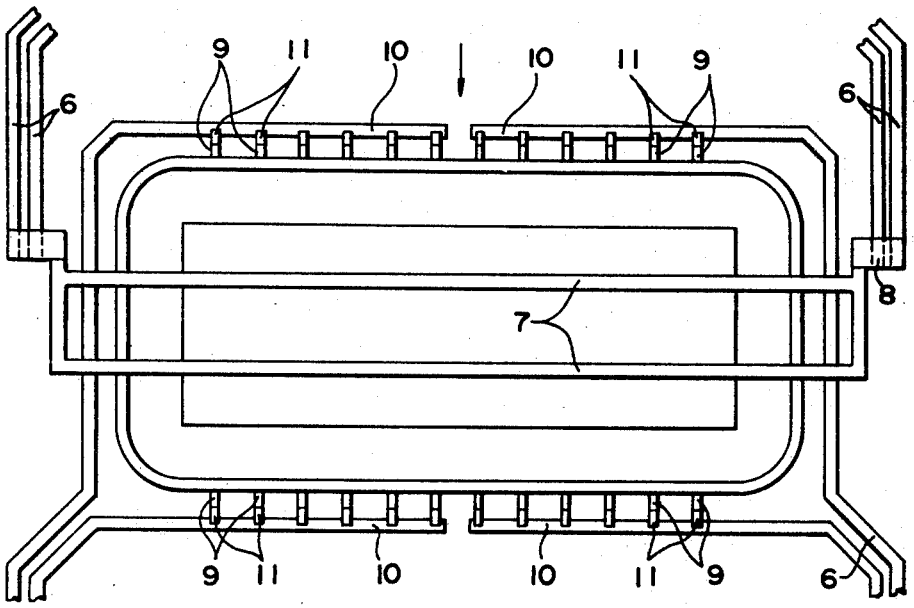
Figure 4:
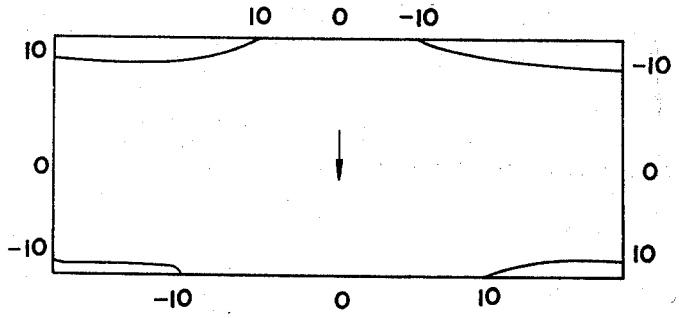
Figure 5:
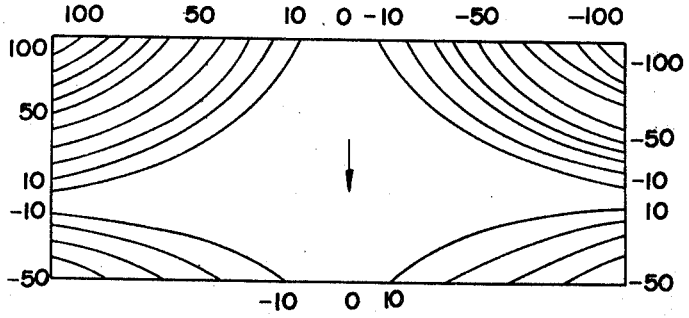
Figure 6:
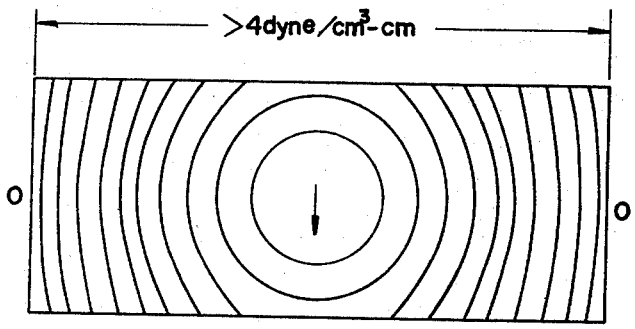
Figure 7:
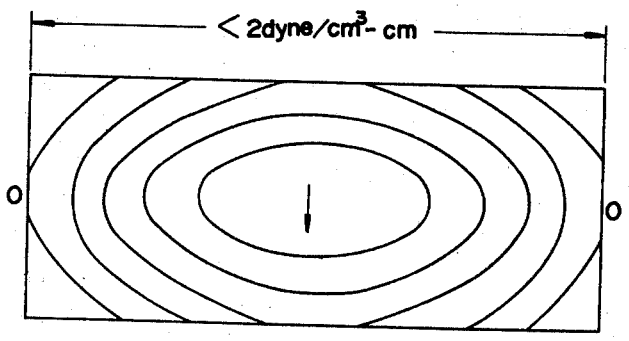

The present invention will be explained in more detail with reference to the attached drawings, in which:

FIG. 1 is a schematic plan view of a cell incorporating one embodiment of an improved conducting bus bars arrangement of the invention and FIG. 2 is a side view of the same;

FIG. 3 is a schematic plan view of the cell which employed the conventional conducting bus bars arrangement according to the prior art FIGS. 4 and 5 are diagrams illustrating the magnitude of the vertical component (Hz) of the magnetic field measured at the bath-metal interface area in the underanode region of a cell of the present invention and a conventional cell, respectively; and Similarly, FIGS. 6 and 7 are diagrams showing the potential distribution of electromagnetic forces at the bath-metal interface exerted by the horizontal component ($Hxy$) of the magnetic field and vertical component (Iz) of the current flow in the underanode region of the cell of a present invention and a conventional cell, respectively.

In each drawing the arrow indicates general direction of the current flow in the row of the cells.

In FIGS. 1 through 3, there is shown one of the plurality of cells which are disposed in a row in an aluminum production pot room with a side by side placement and in electrical series and the same parts of the cells illustrated in the drawings are designated by same numerals. In the drawing, each cell has a rectangular steel potshell 1 lined with conducting carboneous material which serves as the carbon cathode 2. Molten electrolytic bath 3 mainly composed of fused cryolite fills said potshell 1. The bath 3 contains a proper concentration of dissolved alumina, which is electrolytically reduced to aluminum metal during cell operation.

The thus-produced aluminum metal precipitates along the bottom of the cell to form a molten aluminum layer (4) underlying the molten bath 3 and resting on the carbon cathode 2. The carbon anodes 5 are suspended by conventional fasteners, not shown, from the anode bus bars 7 installed above the cell in the longitudinal direction of the cell.

The anode bus bars 7 received electric current from the adjacent upstream cell through line bus bars 6 and anode risers 8 and the current for electrolysis in the cell flows from the anode bus bars 7 through carbon anodes 5, the electrolytic bath 3, the molten aluminum layer 4 to the carbon cathode 2. In the carbon cathode 2, a plurality of cathode collector bars 9 are embedded in parallel at a proper spacing and protrude at their ends from the upstream and downstream longitudinal sides of the potshell 1. The current from each side of the cathode collector bars 9 are taken out by cathode bus bars 10 which are connected to the protruding ends of the cathode collector bars 9 by means of flexible cathode risers 11.

In the conventional side by side placement cell, the cathode bus bars 10 are installed in a similar manner along the upstream and downstream sides of the cell, being diverted in a symmetrical way to the left and right and extending to the corresponding end of the potshell 1 parallel to the longitudinal axis as shown in FIG. 3.

In the present invention, however, from their connection to the cathode collector bars 9, the upstream side cathode bus bars 10' are directed underneath potshell 1 in a direction parallel to the transverse axis of the potshell 1 and then outwardly to the left and the right along the longitudinal center line of the potshell 1 as shown in FIGS. 1 and 2. The cathode collector bars 9 can be connected to the cathode bus bars 10' one by one or in groups of a convenient number (two in case of the FIG. 1).

Although the overall arrangement of cathode bus bars as explained above is, in principle, symmetrical with regard to the transverse axis of the cell, it is possible to shifting the symmetric axis of those bars, which remains parallel to the transverse axis of the potshell 1, to the left or right in order to compensate for the magnetic effect from the adjacent row of the cells.

With a cell employing the improved bus bars arrangement of the invention, it is possible to establish a very favorable pattern for an extremely small vertical component of the magnetic field at the bath-metal interface owing to proper compensation of the magnetic fluxes generated by the various current conducting elements especially at the neighbourhood of the corners of the cell on the upstream side, where in the case of the conventional cell an extremely large vertical component of the magnetic field is present.

Furthermore, in the operation of any aluminum electrolytic cell, the dissolved alumina in the electrolytic bath is consumed more rapidly in the central area of the cell, i.e. under the anode, than in the peripheral area of fresh cell where the alumina is supplied during cell operation. For this reason it is desirable to maintain a rapid rate of diffusion of dissolved alumina from the area of supply to the central reaction area of the electrolytic bath. Moreover, the electrolytic bath temperature under the bottom surface of the anode carbon is generally higher than the bath temperature in the peripheral area of the cell. It is also desirable to minimize such temperature difference to obtain a high operational efficiency.

In this invention, owing to the aforementioned change in the upstream cathode bus bars arrangement, the horizontal component of the magnetic field at the bath-metal interface in the direction of the longitudinal axis of the cell is very large at the both ends of the cell and thus the potential gradient of electromagnetic force along the longitudinal axis of the cell is very large in comparison with the conventional cell. The presence of the potential gradient of the electromagnetic force based on the horizontal magnetic field under the anode brings about a circulation movement of the electrolytic bath, the intensity of which is naturally dependent on a degree of the above mentioned potential gradient. This large potential gradient creates sufficient circulation movement of the electrolytic bath from the peripheral area to the central area of the cell as to promote rapid dissolution and diffusion of the added alumina and establish a better temperature distribution in the bath, which permits more stable and efficient cell operation, as a whole.

FIGS. 4 and 5 are diagrams examplifying the magnitude of the vertical component (Hz) of the magnetic field at the bath-metal interface for the cells of a current intensity of 160,000 amperes and a cell size of 7m. × 4m. for the cell of the present invention and the conventional cell, respectively. FIGS. 6 and 7 are the diagrams showing the potential distribution of electromagnetic force at around the bath metal interface induced by the horizontal component (H*xy*) of the magnetic field for the same cells as in FIGS. 4 and 5.

As can be seen in FIGS. 4 and 5, whereas the vertical component (Hz) of the magnetic field at the bath-metal interface in the conventional cell varies greatly in different points in the cell geometry and its maximum value is as high as 100 Gauss at the both corners of the upstream side of the cell, this invention gives a very uniform distribution of the vertical component (Hz) with very small magnitude at all the points in the cell, with the value at the upstream corners as low as 10 Gauss and nearly zero for almost entire central area of the cell. This means that the horizontal circulation movement of the molten aluminum layer caused by the interaction between the vertical component (Hz) of the magnetic field and the horizontal component of the current flow (I*xy*) in the molten aluminum layer is so small that it can be entirely neglected.

Furthermore, as can be seen in FIGS. 6 and 7 the potential gradient at the bath metal interface area along the longitudinal axis of the cell induced by the horizontal component of the magnetic field is as large as 4 dyne/cm$^2$-cm for this invention as compared with 2 dyne/cm$^2$-cm for the conventional cell. This means that more effective circulation and stirring of the electrolytic bath, as distinguished from the molten aluminum layer, is obtained in the cell with this invention than in the conventional cell.

Thus the advantage of this invention is that, because of the minimized vertical component of the magnetic field in the vicinity of the molten aluminum layer accomplished by the improved cathode bus bars arrangement, horizontal circulation of the metal layer is almost completely eliminated along with the operational difficulties caused by such metal movement. At the same time operational efficiency is improved by promoting a faster dissolution and diffusion of the alumina and establishing a better temperature distribution in the bath by means of making the horizontally-acting electromagnetic potential gradient larger than in conventional cells and thus achieving better stirring of the electrolytic bath layer.

What is claimed is:

1. In a potline having a plurality of electrolytic cells for the reduction of aluminum, each cell having a rectangular potshell adapted to be arranged with other similar potshells in serially electrically connected side by side relationship to make a row of electrolytic cells wherein the lengthwise axis of each potshell is arranged generally perpendicularly to the row of cells, each potshell having an electrically conductive cathode potlining and a plurality of cathode collector elements extending generally normal to the lengthwise potshell axis in electrical engagement with said potlining with their ends projecting exteriorly of said potshell, and a current carrying bus structure disposed exteriorly of said potshell for carrying current from its cathode collector elements to the anode of the next downstream cell in said row of cells, said bus structure including pluralities of upstream and downstream cathode bus bars connected to the corresponding ends of said cathode collector elements, anode bus bars connected to the anode, and line bus bars connecting the cathode bus bars of one potshell in series to the anode bus bars of the next potshell, the improvement wherein said line bus bars at their cathode ends at least in the vicinity of each potshell extend along the opposite ends of the potshell outside its confines to connect with the ends of two opposed groups of upstream cathode bus bars, the bus bars in said groups including a. transverse sections extending perpendicularly of the lengthwise potshell axis spaced intervals along said axis, each such transverse section being connected to the upstream end of at least one cathode collector bar, and b. longitudinal sections stretching outwardly to the potshell ends in opposite directions beneath the potshell generally parallel to the lengthwise potshell axis, with the longitudinal sections in each group having their inward ends terminating at spaced apart points beneath said potshell connecting with the corresponding transverse sections, and said downstream cathode bus bars extend in oppositely directed groups generally parallel to the lengthwise potshell axis adjacent to and exteriorly of the downstream side of said potshell, each such downstream cathode bus bar being connected between one of said line bus bars and the downstream ends of a group of said cathode collector bars.

2. The potline of claim 1 wherein the longitudinal sections of each group of upstream cathode bus bars are disposed generally symmetrically with respect to the transverse cell axis.

3. The potline according to claim 1 including at least two lines of the potshells arranged generally proximate to one other, and wherein the parallel sections of said groups are shifted out of symmetry with the transverse potshell axis to compensate the effect of magnetic field of the cells of an adjacent row so as to symmetrize vertical magnetic field pattern and potential distribution with regard to said transverse axis.

4. The improvements in a potline according to claim 1 wherein:

each of said transverse sections of said upstream side cathode bus bars is connected to the upstream ends of a plurality of cathode collector bars of said cell.

5. The improvements in a potline according to claim 1 wherein:

each of said transverse sections of said upstream side cathode bus bars is connected to one upstream side collector bars of said cell.

* * * * *

UNITED STATES PATENT AND TRADEMARK OFFICE

CERTIFICATE OF CORRECTION

PATENT NO. : 3,969,213

DATED : July 13, 1976

INVENTOR(S) : Shoji Yamamoto et al

It is certified that error appears in the above-identified patent and that said Letters Patent are hereby corrected as shown below:

Column 5, line 27 (claim 1, line 29), after "axis" insert -- at --.

Signed and Sealed this

Fourteenth Day of September 1976

[SEAL]

*Attest:*

RUTH C. MASON
*Attesting Officer*

C. MARSHALL DANN
*Commissioner of Patents and Trademarks*